US005251375A

United States Patent [19]

Crucq et al.

[11] Patent Number: 5,251,375

[45] Date of Patent: Oct. 12, 1993

[54] SHAVING APPARATUS

[75] Inventors: Jacobus Crucq; Marinus J. J. Dona; Wilhelmus M. Walraven, all of Eindhoven, Netherlands

[73] Assignee: U.S. Philips Corp., New York, N.Y.

[21] Appl. No.: 848,813

[22] Filed: Mar. 10, 1992

[30] Foreign Application Priority Data

Mar. 12, 1991 [NL] Netherlands ..... 9100439

[51] Int. Cl.[5] ..... B26B 19/12

[52] U.S. Cl. ..... 30/43.9; 30/43.3; 30/42

[58] Field of Search ..... 30/42, 43.3, 43.7, 43.8, 30/43.9, 43.91, 43.92, 44; 310/47

[56] References Cited

U.S. PATENT DOCUMENTS

| | | | |
|---|---|---|---|
| 2,149,403 | 3/1939 | Muros | 30/43.3 |
| 2,318,351 | 5/1943 | Alexay | 30/43.3 |
| 2,346,235 | 4/1944 | Romao | 30/43.3 |
| 4,481,552 | 11/1984 | Dona et al. | 360/97 |
| 4,594,778 | 6/1986 | Dona et al. | 30/43.9 |
| 4,628,238 | 12/1986 | Smueders et al. | 318/653 |
| 4,628,607 | 12/1986 | Bertram et al. | 30/43.92 |
| 4,760,297 | 7/1988 | Schemmann et al. | 30/43.92 |
| 4,769,582 | 9/1988 | Crucq et al. | 318/345 C |
| 4,868,435 | 9/1989 | Diefenbach et al. | 30/43.92 |
| 4,955,937 | 9/1990 | Dona et al. | 82/11 |
| 5,067,377 | 11/1991 | Dona et al. | 82/138 |
| 5,105,692 | 4/1992 | Dona et al. | 82/123 |
| 5,105,693 | 4/1992 | Hagen et al. | 82/137 |

FOREIGN PATENT DOCUMENTS

| | | | |
|---|---|---|---|
| 0276502 | 8/1988 | European Pat. Off. . | |
| 0394105 | 10/1990 | European Pat. Off. . | |
| 1448872 | 9/1976 | United Kingdom | 30/43.3 |

*Primary Examiner*—Hien H. Phan
*Assistant Examiner*—Paul M. Heyrana, Sr.
*Attorney, Agent, or Firm*—Ernestine C. Bartlett

[57] ABSTRACT

A shaving apparatus comprises a housing provided with a first shaving member having a first cutting edge and with a second shaving member having a second cutting edge, which second shaving member is drivable relative to the first shaving member, the movement of the second cutting edge relative to the first cutting edge in a plane transverse to the cutting edges being composed of the movements in two main directions in this plane. The second shaving member is provided with a carrier mounted in the housing so as to be movable in both main directions and the carrier comprises two surfaces which extend transversely of the main directions and which engage against a rotatably drivable cam disc.

15 Claims, 2 Drawing Sheets

SHAVING APPARATUS

FIELD OF THE INVENTION

The invention relates to a shaving apparatus comprising a housing provided with a first shaving member having a first cutting edge and with a second shaving member having a second cutting edge, which second shaving member is drivable relative to the first shaving member, the movement of the second cutting edge relative to the first cutting edge being composed of the movements in two main directions.

BACKGROUND OF THE INVENTION

Such a shaving apparatus is known from EP-A-276,502 which corresponds substantially to U.S. Pat. No. 4,847,995 issued Jul. 18, 1989. Said document describes a construction in which the second shaving member is driven by means of a linkage.

SUMMARY OF THE INVENTION

An object of the invention is to provide a simpler construction which is less susceptible to dimensional tolerances.

The shaving apparatus in accordance with the invention is characterised in that the second shaving member is provided with a carrier mounted in the housing so as to be movable in both main directions and the carrier comprises two surfaces which extend transversely of the main directions and which engage against a rotatably drivable cam disc.

DESCRIPTION OF THE DRAWINGS

Some embodiments of the invention will now be described, by way of example, with reference to the FIGS.

DETAILED DESCRIPTION OF PREFERRED EMBODIMENTS

Figure 1:
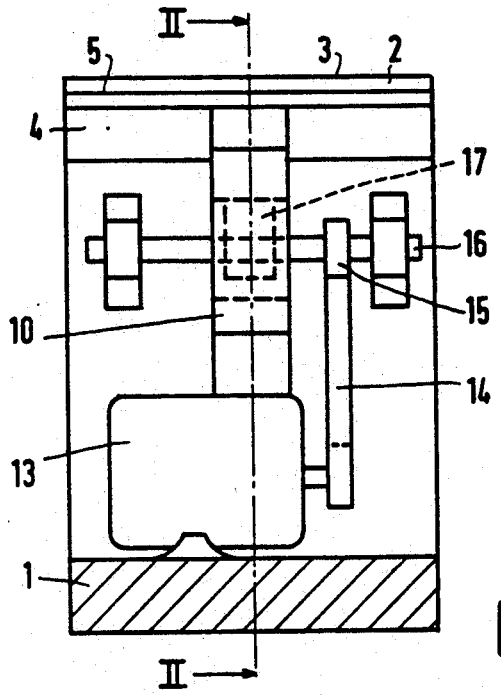
FIG. 1 shows a shaving apparatus in accordance with the invention in a sectional view taken on the line I—I in FIG. 2.
Figure 3:
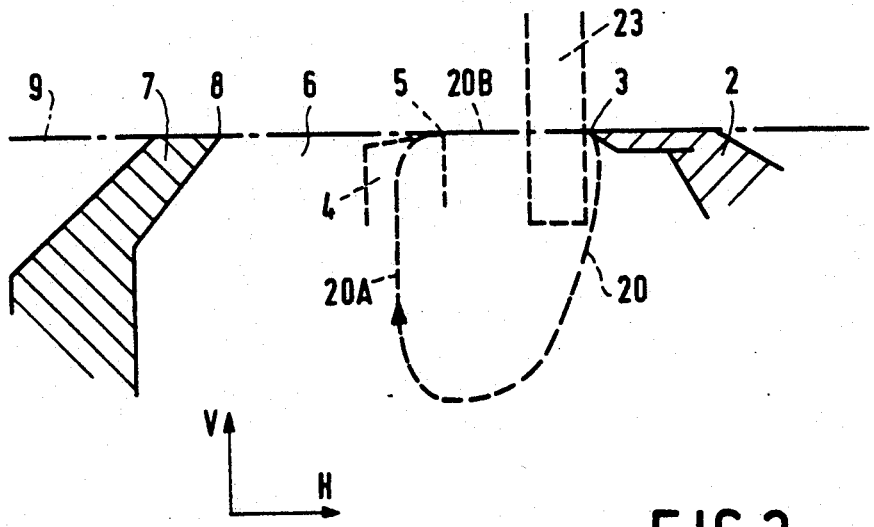
FIG. 3 shows a part of the sectional view of FIG. 2 to an enlarged scale.
Figure 2:
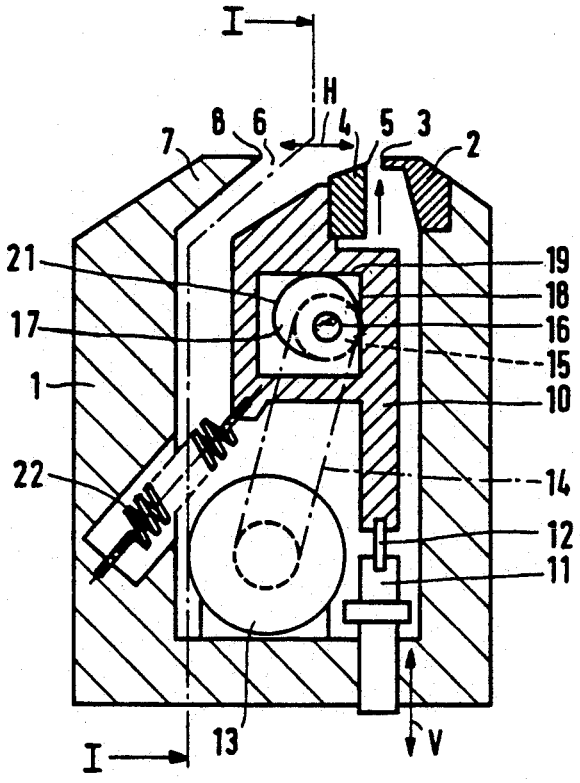
FIG. 2 is a sectional view taken on the line II—II in FIG. 1.

The apparatus as shown in FIGS. 1, 2 and 3 comprises a housing 1 with a first shaving member 2 having a first cutting edge 3 and a second shaving member 4 having a second cutting edge 5, said second shaving member being drivable with respect to the first shaving member 2. The apparatus has a hair-entry aperture 6 between the first shaving member 2 and a skin-tautening member 7. The skin-tautening member 7 forms, for example, part of the housing 1. The first cutting edge 3 and the edge 8 of the skin-tautening member 7 define a work plane 9.

The second shaving member 4 has a carrier 10 secured to a coupling element 11. The coupling element 11 is supported in the housing 1 to be slidable in the direction V. The carrier 10 is secured to the coupling element 11 by means of a flexible element 12.

The housing 1 accommodates an electric motor 13 which is coupled to a pulley 15 on a shaft 16 by means of a drive belt 14. The shaft 16 also carries a cam disc 17 which engages against the surfaces 18 and 19 of the carrier 10. The shaft 16 and hence the cam disc can thus be rotated, causing the second shaving member 4 to be moved relative to the first shaving member.

Figure 4:
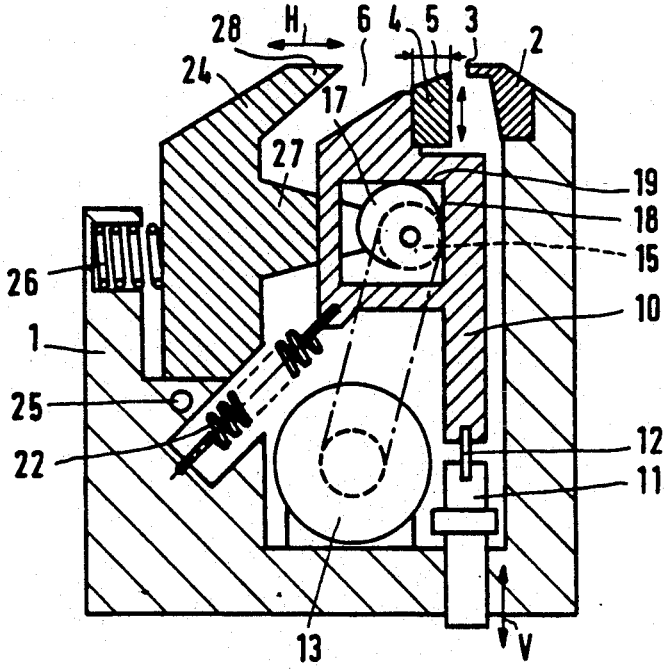
FIG. 4 shows another embodiment in a sectional view similar FIG. 2.

This movement, for example in a plane transverse to the cutting edges 3 and 5, i.e. in the plane of drawing of FIG. 2, may be in accordance with an endless path 20, see also FIG. 3 and FIG. 4. The movement may be regarded as a combination of the movements in two main directions H and V and in the present case V is perpendicular to the work plane 9 and H is parallel to the work plane 9. In general, the main directions will be selected to be perpendicular to one another. The carrier 10 and hence the second cutting edge 5 can perform movements in the main direction V because the carrier is secured to the coupling element 11 which is slidable in this direction, the flexible element 12, which acts as a pivotal element, enabling movement in the direction H perpendicular thereto. Thus, the second cutting member 4 is driven by the cam disc 17 with the profile 21 which during rotation alternately engages with the surfaces 18 and 19 of the carrier 10, which surfaces extend transversely of the main directions H and V. A resilient element 22 ensures that the carrier remains in contact with the surfaces 18 and 19 of the cam disc 17.

During use of the shaving apparatus the work plane 9 will substantially coincide with the skin to be shaved. The curve 20 representing the path of movement of the cutting edge 5 relative to the cutting edge 3 preferably comprises a path section 20A in which the cutting edge 5 is oriented substantially in a main direction V transverse to the work plane and is moved towards the work plane. In addition, the path 20 preferably comprises a path section 20B which adjoins the section 20A and in which the cutting edge 5 is moved substantially in a main direction H parallel to the work plane 9 and towards the first cutting edge 3. In this way a skin portion bulging through the aperture 6 is pushed away during the movement along the path section 20A. This prevents the skin from being caught between the two shaving members. During the movement of the cutting edge 5 along the path section 20B, which is situated for example in the work plane 9, a hair 23 situated between the two cutting edges 3 and 5 is severed in the plane of the skin.

With the above construction the shape of the curve 20 is dictated mainly by the shape of the profile 21 of the cam disc 17. This enables comparatively intricate curves to be realized in a simple way. Since the surfaces 18 and 19 engage with the cam disc 17 without clearance and the cam disc can be arranged close to the second cutting edge 5 it is possible to obtain a high degree of accuracy.

Obviously, it is also possible to employ separate cam discs for the surfaces 18 and 19, which cam discs are axially spaced on the shaft 16.

The embodiment shown in FIG. 4 comprises the same mechanism as described with reference to FIGS. 1 and 2. However, the housing also comprises a movable skin-tautening member 24. This skin-tautening member 24 is pivotable about a pivot 25 and is supported by a resilient element 26, so that the driving arm 27 also engages against the cam disc 17. In this way the edge 28 of the skin-tautening member can be reciprocated in the main direction H.

We claim:

1. A shaving apparatus comprising a housing provided with a first shaving member having a first cutting edge and with a second shaving member having a second cutting edge, which second shaving member is drivable relative to the first shaving member, the movement of the second cutting edge relative to the first cutting edge being composed of the movements in two main directions H and V where H is parallel to the work plane, V is perpendicular to the work plane, and the work plane coincides with the skin to be shaved;

wherein the second shaving member is provided with a carrier mounted in the housing so as to be movable in both main directions, said carrier comprising at least two surfaces which extend transversely of the main directions and which engage against a cam disc rotatably driven about a rotation axis extending parallel to the at least two surfaces.

2. A shaving apparatus as claimed in claim 1, wherein the second shaving member is mounted in the housing by means of a coupling element, which coupling element is arranged in the housing to be slidable in one of the main directions, the carrier being secured to the coupling element by means of a pivotal element.

3. A shaving apparatus as claimed in claim 2 wherein the carrier is urged against the cam disc under the influence of a resilient element.

4. A shaving apparatus as claimed in claim 2 wherein the apparatus has a hair-entry aperture between the first cutting edge and an edge of a skin-tautening member, which skin-tautening member defining a work plane, the path of movement of the second cutting edge relative to the first cutting edge comprising a path section oriented substantially in a main direction transverse to the work plane and towards the work plane and, adjoining said path section, a path section oriented substantially in a main direction parallel to the work plane and towards the first cutting edge.

5. A shaving apparatus as claimed in claim 2 wherein the apparatus comprises a movable skin-tautening element, with a driving arm which also engages against a cam disc.

6. A shaving apparatus as claimed in claim 1 wherein the carrier is urged against the cam disc under the influence of a resilient element.

7. A shaving apparatus as claimed in claim 6 wherein the apparatus has a hair-entry aperture between the first cutting edge and an edge of a skin-tautening member, which skin-tautening member defining a work plane, the path of movement of the second cutting edge relative to the first cutting edge comprising a path section oriented substantially in a main direction transverse to the work plane and towards the work plane and, adjoining said path section, a path section oriented substantially in a main direction parallel to the work plane and towards the first cutting edge.

8. A shaving apparatus as claimed in claim 6 wherein the apparatus comprises a movable skin-tautening element, with a driving arm which also engages against a cam disc.

9. A shaving apparatus as claimed in claim 1 wherein the apparatus has a hair-entry aperture between the first cutting edge and an edge of a skin-tautening member, which skin-tautening member forms part of the housing, the first cutting edge and the edge of the skin-tautening member defining a work plane, the path of movement of the second cutting edge relative to the first cutting edge comprising a path section oriented substantially in a main direction transverse to the work plane and towards the work plane and, adjoining said path section, a path section oriented substantially in a main direction parallel to the work plane and towards the first cutting edge.

10. A shaving apparatus as claimed in claim 1, wherein the apparatus comprises a movable skin-tautening element, with a driving arm which also engages against a cam disc.

11. A shaving apparatus comprising a housing provided with a first shaving member having a first cutting edge and with a second shaving member having a second cutting edge, which second shaving member is drivable relative to the first shaving member, the movement of the second cutting edge relative to the first cutting edge being composed of the movements in two main directions H and V where H is parallel to the work plane, V is perpendicular to the work plane, the work plane coincides with the skin to be shaved, and the main directions are perpendicular to one another;

wherein the second shaving member is provided with a carrier mounted in the housing so as to be movable in both main direction, said carrier comprising at least two surfaces which extend transversely of the main directions and which engage against a cam disc rotatably driven about a rotation axis extending parallel to the at least two surfaces.

12. A shaving apparatus as claimed in claim 11 wherein the second shaving member is mounted in the housing by means of a coupling element arranged in the housing to be slidable in one of the main directions, the carrier being secured to the coupling element by a pivotal element.

13. A shaving apparatus as claimed in claim 12 wherein the carrier is urged against the cam disc by a resilient element.

14. A shaving apparatus as claimed in claim 13 wherein the apparatus has a hair-entry aperture between the first cutting edge and an edge of a skin-tautening member, which skin-tautening member forms part of a housing, the first cutting edge and the edge of the skin-tautening member defining a work plane, the path of movement of the second cutting edge relative to the first cutting edge comprising a path section oriented substantially in a main direction transverse to the work plane and towards the work plane and, adjoining the path section, a path section oriented substantially in a main direction parallel to the work plane and towards the first cutting edge.

15. A shaving apparatus as claimed in claim 14 wherein the apparatus comprises a movable skin-tautening element, with a driving arm which also engages against a cam disc.

* * * * *